US006029728A

United States Patent [19]

Hetem

[11] Patent Number: 6,029,728

[45] Date of Patent: Feb. 29, 2000

[54] CONTINUOUS FLOW DEVICE FOR COMPUTER PRINTER INVOICES

[76] Inventor: James Hetem, 425 Roselle St. Apt. 1F, Linden, N.J. 07036

[21] Appl. No.: 08/771,634

[22] Filed: Dec. 20, 1996

[51] Int. Cl.[7] ..... B65H 21/00

[52] U.S. Cl. ..... 156/505; 156/304.3; 156/507

[58] Field of Search ..... 156/157, 304.3, 156/502, 505, 507; 242/551, 554.1, 556.1

[56] References Cited

U.S. PATENT DOCUMENTS

| | | | |
|---|---|---|---|
| 3,776,795 | 12/1973 | Stevenson | 156/505 X |
| 4,056,426 | 11/1977 | Sipin | 156/505 |
| 4,239,582 | 12/1980 | McGrath | 156/157 X |
| 4,252,597 | 2/1981 | Monroe | 156/505 |
| 4,390,389 | 6/1983 | Bunas et al. | 156/502 |
| 4,487,645 | 12/1984 | Weston | 156/157 |
| 4,564,184 | 1/1986 | Rumpel | 156/502 X |
| 5,037,078 | 8/1991 | Oguchi et al. | 156/507 X |
| 5,092,573 | 3/1992 | Abreu | 156/502 X |
| 5,286,015 | 2/1994 | Uzep | 156/157 X |
| 5,679,195 | 10/1997 | O'Dwyer et al. | 156/505 X |
| 5,779,851 | 7/1998 | Ifkovits et al. | 156/505 |

FOREIGN PATENT DOCUMENTS

| | | | |
|---|---|---|---|
| 0059981 | 9/1982 | European Pat. Off. | 156/502 |
| 63-74861 | 4/1988 | Japan | 156/505 |

*Primary Examiner*—Mark A. Osele

[57] ABSTRACT

A continuous flow device for use in association with computer printer invoices including side tear holes, the apparatus comprises an invoice support assembly comprising a center section and first and second arm sections, the center section having a bottom region and a top region, the top surface having two short side edges and two long side edges, each arm section of the invoice support assembly having inner and outer long side edges and two short side edges, each inner long side edge being hingedly coupled to the top region of the center section; and a plurality of connectors each including an adhesive surface thereon, an adhesive strip being coupled on top of the adhesive surface, in an operative orientation a user placing a connector on the center section and removing the adhesive strip, the user then positioning a first invoice on the first arm section and a second invoice on the second arm section thereby coupling the invoices together.

8 Claims, 4 Drawing Sheets

CONTINUOUS FLOW DEVICE FOR COMPUTER PRINTER INVOICES

BACKGROUND OF THE INVENTION

1. Field of the Invention

The present invention relates to a continuous flow device for computer printer invoices and more particularly pertains to allowing a user to connect computer invoices to allow for continuous flow through a dot-matrix printer.

2. Description of the Prior Art

The use of computer invoice accessories is known in the prior art. More specifically, computer invoice accessories heretofore devised and utilized for the purpose of allowing users to load and print computer invoices are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,448,558 to Weingarten discloses a computer paper printer support.

U.S. Pat. No. 4,070,223 to Stalzer discloses an apparatus and method for introducing connected forms into an associated device.

U.S. Pat. No. 4,568,108 to Simpson discloses a continuous forms leader.

U.S. Pat. No. 4,529,227 to Fields discloses a device for introducing forms into a computer printer.

U.S. Pat. No. 4,545,517 to Olson discloses a continuous forms leader.

U.S. Pat. No. 4,961,666 to Pitts et al. discloses binding tabs.

U.S. Pat. No. Des. 294,954 to Nagahiro discloses a sheet paper feeder for printer.

While these devices fulfill their respective, particular objective and requirements, the aforementioned patents do not describe a continuous flow device for computer printer invoices for allowing a user to connect computer invoices to allow for continuous flow through a dot-matrix printer.

In this respect, the continuous flow device for computer printer invoices according to the present invention substantially departs from the conventional concepts and designs of the prior art, and in doing so provides an apparatus primarily developed for the purpose of allowing a user to connect computer invoices to allow for continuous flow through a dot-matrix printer.

Therefore, it can be appreciated that there exists a continuing need for new and improved continuous flow device for computer printer invoices which can be used for allowing a user to connect computer invoices to allow for continuous flow through a dot-matrix printer. In this regard, the present invention substantially fulfills this need.

SUMMARY OF THE INVENTION

In the view of the foregoing disadvantages inherent in the known types of computer invoice accessories now present in the prior art, the present invention provides an improved continuous flow device for computer printer invoices. As such, the general purpose of the present invention, which will be described subsequently in greater detail, is to provide a new and improved continuous flow device for computer printer invoices and method which has all the advantages of the prior art and none of the disadvantages.

To attain this, the present invention essentially comprises a new and improved continuous flow device for use in association with computer printer invoices including side tear holes, the apparatus comprising, in combination: an invoice support assembly comprising a center section and first and second arm sections, the center section being formed in a generally triangular orientation with a bottom region including a planar bottom surface and two inwardly angled side surfaces, a top region including a planar top surface having a smaller width than the bottom surface, the top region having two vertical side walls, one vertical side wall including a generally rectangular adhesive roll holder attached thereto, each inwardly angled side surface including a bore extending therein, the bore including rectangular side portions and a semispherical central section, the top surface being formed in a generally rectangular configuration with two short side edges, two long side edges and four corners, each corner including a generally rectangular notch extending therein, each short side edge including a plurality of conical projection members extending therefrom; each arm section of the invoice support assembly being formed in a planar generally rectangular configuration with inner and outer long side edges and two short side edges, the inner long side edge of each arm section including a generally rectangular shaped extension member projecting therefrom adjacent each short side edge, each projection member being hingedly coupled within a notch of the top region of the center section, four struts, one strut being positioned within each bore in the center section, each strut being coupled to an arm section to provide support thereto, each short side edge including a plurality of conical projection members extending therefrom; four invoice holders each being hingedly coupled around a short side edge of the arm sections, each invoice holder being formed in a generally rectangular configuration with an upper surface and a side surface, each upper surface including an elongated oval aperture, the aperture of each holder being positioned around two conical projection members of the arm sections; a box clip formed in a elongated generally J-shaped configuration with a linear upper section, a linear lower section and a curved hinge section, the upper section having a greater length than the lower section, the hinge section being pivotally coupled to the bottom surface of the center section; and a plurality of connectors, each connector being formed in a generally rectangular configuration with two long side edges and two short side edges, each long side edge being coupled to a long side edge of another connector, perforations being positioned between the long side edges of each connector, each short side edge including a plurality of holes and a side perforation, the connectors further including an adhesive surface extending between the side perforations, an adhesive strip being coupled on top of the adhesive surface, in an operative orientation a user placing a connector on the center section with the holes around the conical projection members and removing the adhesive strip, the user then positioning a first invoice on the first arm section with its side tear holes around the conical projection members and a second invoice on the second arm section with its side tear holes around the conical projection members then raising each arm to be supported by struts, thereby coupling the invoices together.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved continuous flow device for computer printer invoices which has all the advantages of the prior art computer invoice accessories and none of the disadvantages.

It is another object of the present invention to provide a new and improved continuous flow device for computer printer invoices which may be easily and efficiently manufactured and marketed.

It is a further object of the present invention to provide a new and improved continuous flow device for computer printer invoices which is of durable and reliable construction.

An even further object of the present invention is to provide a new and improved continuous flow device for computer printer invoices which is susceptible of a low cost of manufacture with regard to both materials and labor, and which accordingly is then susceptible of low prices of sale to the consuming public, thereby making such a continuous flow device for computer printer invoices economically available to the buying public.

Even still another object of the present invention is to provide a new and improved continuous flow device for computer printer invoices for allowing a user to connect computer invoices to allow for continuous flow through a dot-matrix printer.

Lastly, it is an object of the present invention to provide a new and improved continuous flow device for computer printer invoices the apparatus comprising: an invoice support assembly comprising a center section and first and second arm sections, the center section having a bottom region and a top region, the top surface having two short side edges and two long side edges, each arm section of the invoice support assembly having inner and outer long side edges and two short side edges, each inner long side edge being hingedly coupled to the top region of the center section; and a plurality of connectors each including an adhesive surface thereon, an adhesive strip being coupled on top of the adhesive surface, in an operative orientation a user placing a connector on the center section and removing the adhesive strip, the user then positioning a first invoice on the first arm section and a second invoice on the second arm section then raising each arm to the open position supported by the struts, thereby coupling the invoices together.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
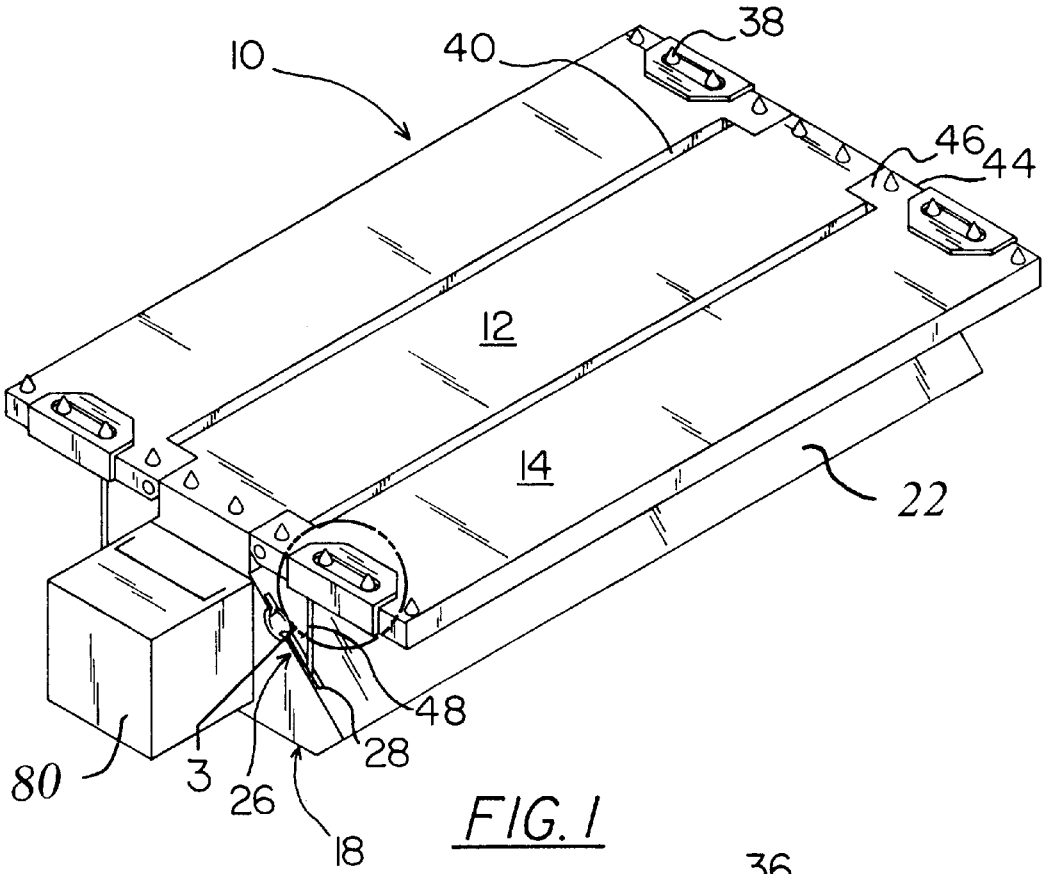
FIG. 1 is a perspective view of the preferred embodiment of the continuous flow device for computer printer invoices constructed in accordance with the principles of the present invention.

With reference now to the drawings, and in particular, to FIG. 1 thereof, the preferred embodiment of the new and improved continuous flow device for computer printer invoices embodying the principles and concepts of the present invention and generally designated by the reference number 10 will be described.

Specifically, it will be noted in the various Figures that the device relates to a new and improved continuous flow device 10. In its broadest context, the device consists of a center section 12, first and second arm sections 14 and connectors 16. Such components are individually configured and correlated with respect to each other so as to attain the desired objective.

The continuous flow device is adapted for use in association with computer printer invoices having side tear holes. In the preferred embodiment of the apparatus the invoices utilized are of the type used with a conventional dot-matrix printer. Either single, duplicate or triplicate invoices could be utilized with the present invention. Note FIG. 1.

Figure 2:
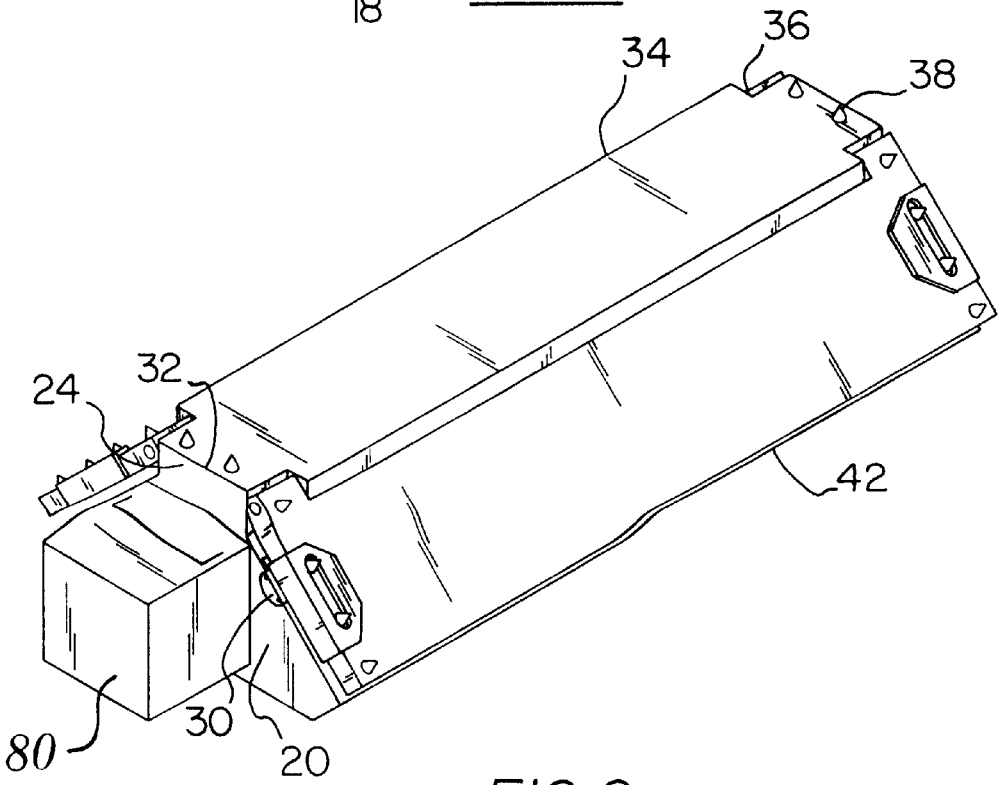
FIG. 2 is a perspective view of the apparatus in a closed orientation.
Figure 3:
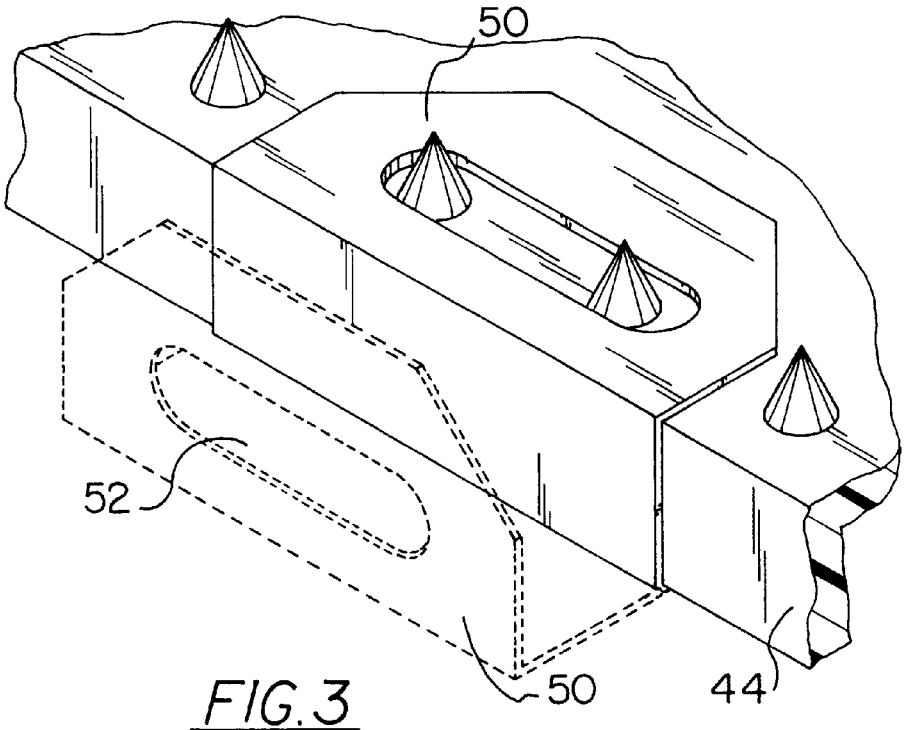
FIG. 3 is an enlarged perspective view illustrating the invoice holder of the apparatus.
Figure 4:
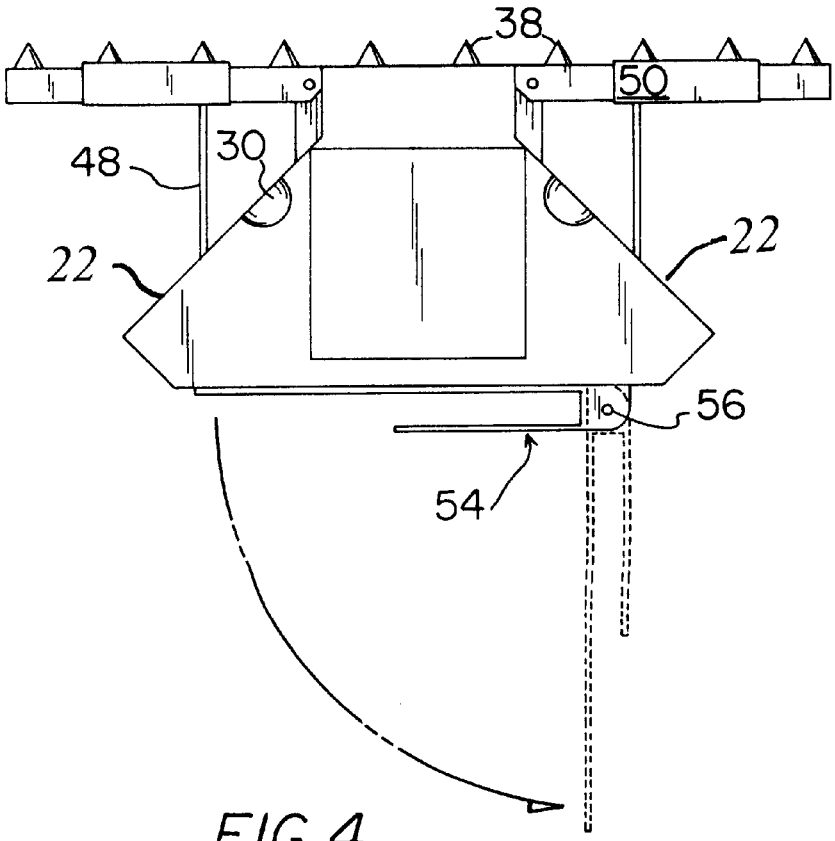
FIG. 4 is a side perspective view illustrating the box clip of the apparatus.

An invoice support assembly 18 comprises a center section 12 and first and second arm sections 14. The center section 12 is formed in a generally triangular configuration with a bottom region 20 which includes a planar bottom surface and two inwardly angled side surfaces 22. The center section further comprises a top region 24 which includes a planar top surface. The top surface has a smaller width than the bottom surface. The top region has two vertical side walls. One vertical side wall includes a generally rectangular adhesive roll dispenser 80 attached to it. The adhesive roll dispenser includes an upper slot to remove connectors. Note FIGS. 1 and 2.

Each inwardly angled side surface includes a bore 26. The bore includes rectangular side portions 28 and a semispherical central section 30. The top surface is formed in a generally rectangular configuration with two short side edges 32, two long side edges 34 and four corners. Each corner includes a generally rectangular notch 36. Each short side edge includes a plurality of conical projection members 38. In the preferred embodiment of the apparatus two extension members extend from the center section. Note FIGS. 1–4.

Each arm section 14 of the invoice support assembly is formed in a planar generally rectangular configuration with inner 40 and outer long side edges 42 and two short side edges 44. The inner long side edge of each arm section includes a generally rectangular shaped extension member 46. The extension member projects from the inner long side edge adjacent to each short side edge of the arm sections. Each projection member 46 is hingedly coupled within a notch of the top region of the center section. Note FIGS. 2–4.

Four struts 48 are included with the apparatus. One strut is positioned within each bore in the center section. Each strut projects outwardly from the elongated part 28 of the bore when the arm sections are raised. When the arm sections are lowered the strut rests inside the bore. Each strut is coupled to an arm section to provide vertical support to it. Each short side edge of the arm sections includes a plurality of conical projection 38 members extending from it. In the preferred embodiment of the apparatus four pairs of projection members extend from each arm section. Note FIGS. 1–3.

Four invoice holders 50 are included with the apparatus. Each of the invoice holders is hingedly coupled around a short side edge of the arm sections. Each invoice holder is formed in a generally rectangular configuration with an upper surface and a side surface. Each upper surface includes an elongated oval aperture 52. The aperture of each holder is positioned around two conical projection members of the arm sections. Note FIGS. 1 and 3.

A box clip 54 is formed in a elongated generally J-shaped configuration with a linear upper section, a linear lower section and a curved hinge section 56. The upper section has a greater length than the lower section. The hinge section is pivotally coupled to the bottom surface of the center section. In a stored orientation the upper section is positioned adjacent to the bottom surface of the center section. In an open orientation the upper section is positioned perpendicular to the bottom surface of the center section. The box clip permits mounting of the apparatus on a box of invoices. Note FIG. 4.

Figure 5:
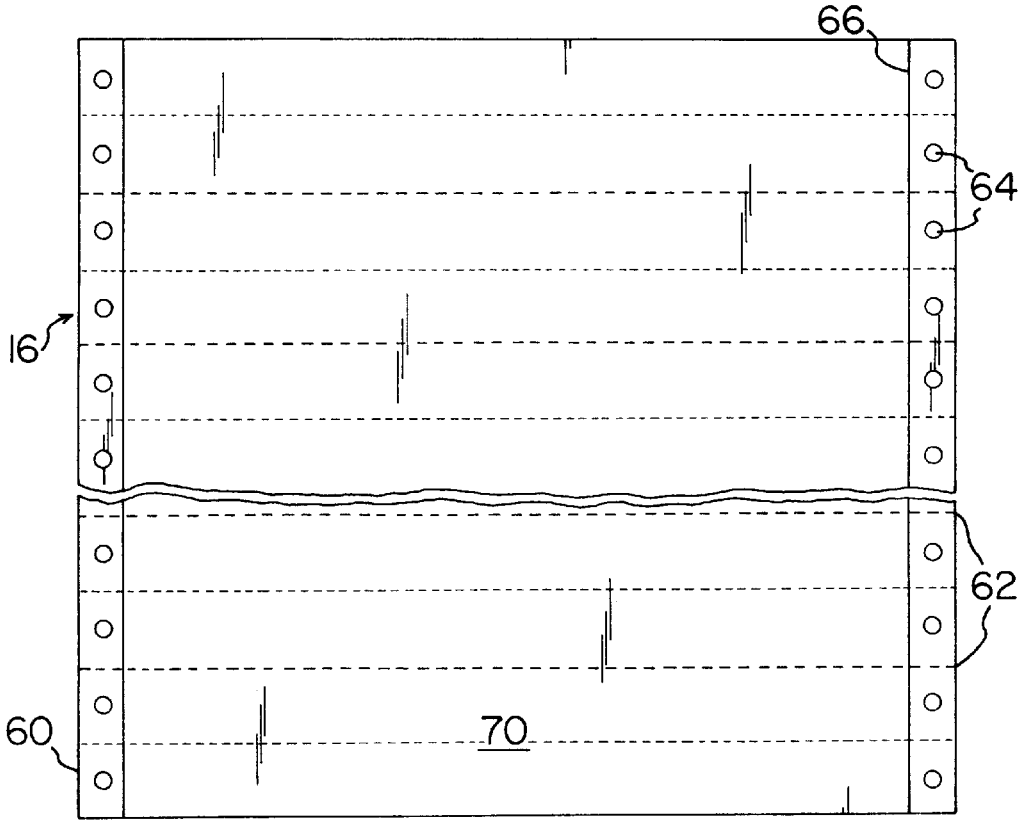
FIG. 5 is a perspective view of a plurality of connectors.
Figure 6:
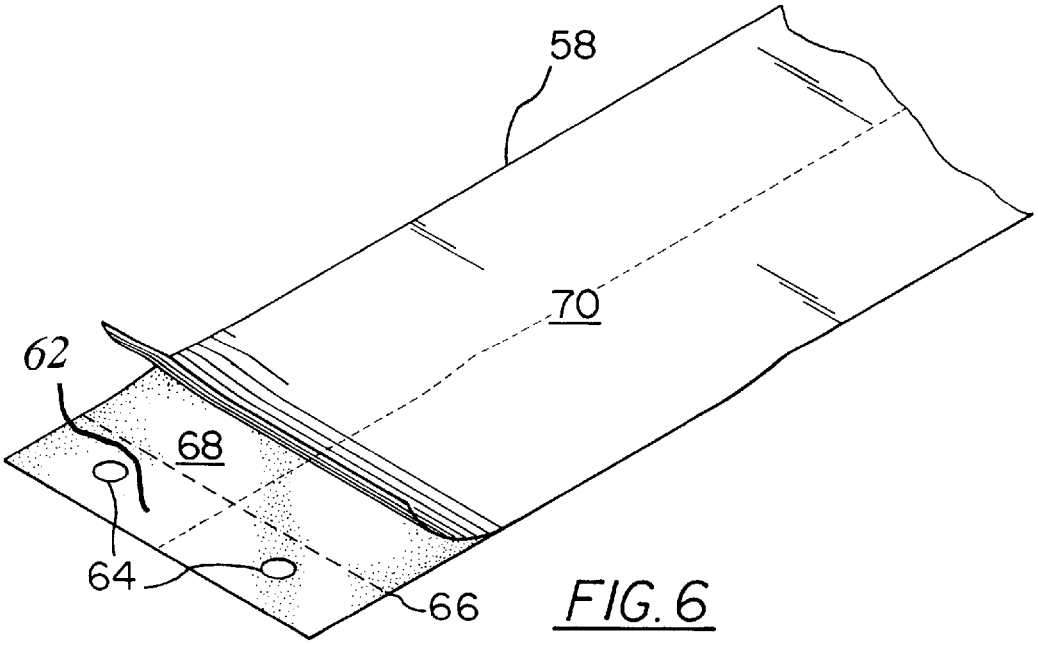
FIG. 6 is a perspective view of a the adhesive surface of a single connector.
Figure 7:
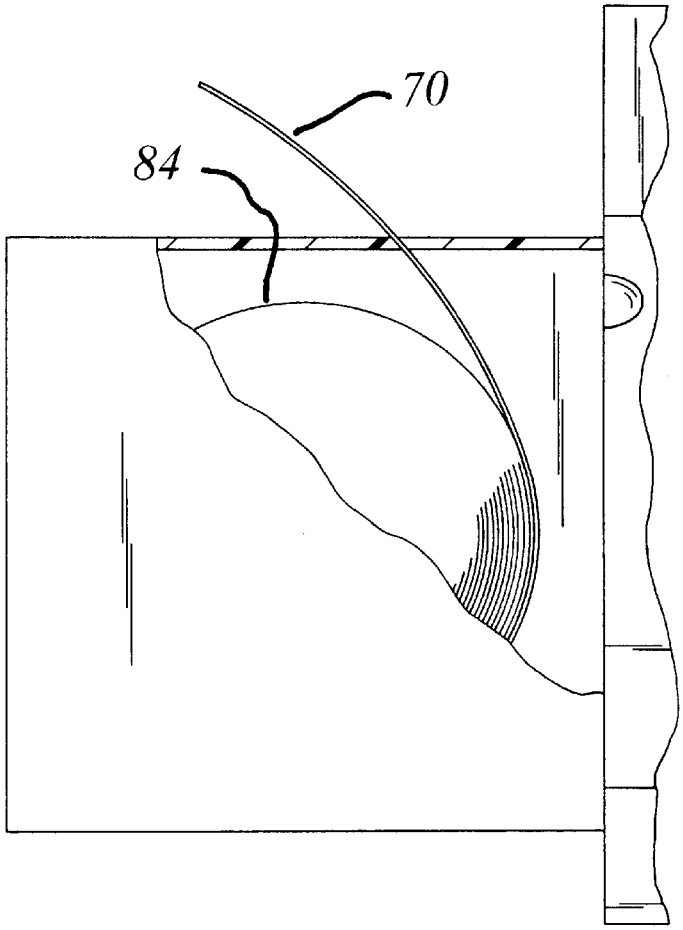
FIG. 7 is a perspective view of the adhesive roll dispenser of the apparatus.
Figure 8:
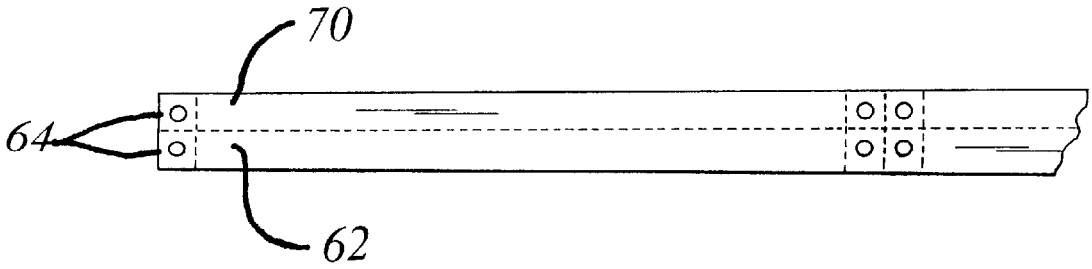
FIG. 8 is a perspective view of the connectors of the appartus.

A plurality of connectors 16 is included with the apparatus. In the preferred embodiment of the apparatus connectors are held on a roll 84 in the adhesive roll holder. In an alternative embodiment of the apparatus, the connectors are formed as a page. Each connector is formed in a generally rectangular configuration with two long side edges 58 and two short side edges 60. Each long side edge is coupled to a long side edge of another connector. Perforations 62 are positioned between the long side edges of each connector. Each short side edge includes a plurality of holes 64 and a side perforation 66. The connectors further include an adhesive surface 68 extending between the short side edges. A release sheet 70 is coupled on top of the adhesive surface. Perforations 62 are positioned along the center of each connector. Note FIGS. 5 and 6.

In an operative orientation, a user places a connector 16 on the center section 12 with the holes 64 around the conical projection members 38. The user then removes the release sheet 70. The user then positions a first invoice on the first arm section with its side tear holes around the conical projection members and positions a second invoice on the second arm section with its side tear holes around the conical projection members. The user then raises the arm sections to upright positions and supporting them by the struts. This action thereby coupling the invoices together. The current invention avoids the inconvenience of having to reload a printer when a box of invoices is finished. Rather, the present invention saves time and energy by allowing a user to link several boxes of invoices together, allowing continuous form-feeding into a printer. Note FIGS. 1–6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A new and improved continuous flow system for use in association with computer printer invoices including side tear holes, the system comprising, in combination:

an invoice support assembly comprising a center section and first and second arm sections, the center section being formed in a generally triangular orientation with a bottom region including a planar bottom surface and two inwardly angled side surfaces, a top region including a planar top surface having a smaller width than the bottom surface, the top region having two vertical side walls, one vertical side wall including a generally rectangular adhesive roll holder attached thereto, each inwardly angled side surface including a bore extending therein, the bore including rectangular side portions and a semispherical central section, the top surface being formed in a generally rectangular configuration with two short side edges, two long side edges and four corners, each corner including a generally rectangular notch extending therein, each short side edge including a plurality of conical projection members extending therefrom;

each arm section of the invoice support assembly being formed in a planar generally rectangular configuration with inner and outer long side edges and two short side edges, the inner long side edge of each arm section including a generally rectangular shaped extension member projecting therefrom adjacent each short side edge, each projection member being hingedly coupled within a notch of the top region of the center section, two struts, one strut being positioned within each bore in the center section, each strut being coupled to an arm section to provide support thereto, each short side edge including a plurality of conical projection members extending therefrom;

four invoice holders each being hingedly coupled around a short side edge of the arm sections, each invoice holder being formed in a generally rectangular configuration with an upper surface and a side surface, each upper surface including an elongated oval aperture, the aperture of each holder being positioned around two conical projection members of the arm sections;

a box clip formed in a elongated generally J-shaped configuration with a linear upper section, a linear lower section and a curved hinge section, the upper section having a greater length than the lower section, the hinge section being pivotally coupled to the bottom surface of the center section; and a plurality of connectors, each connector being formed in a generally rectangular configuration with two long side edges and two short side edges, each long side edge being coupled to a long side edge of another connector, perforations being positioned between the long side edges of each connector, each short side edge including a plurality of holes and a side perforation, the connectors further including an adhesive surface extending between the side perforations, a release sheet being coupled on top of the adhesive surface, in an operative orientation a user placing a connector on the center section with the holes around the conical projection members and removing the release sheet, the user then adapted for positioning a first invoice on the first arm section with its side tear holes around the conical projection members and a second invoice on the second arm section with its side tear holes around the conical projection members and a second invoice on the second arm section with its side tear holes around the conical projection members then raising each arm to be supported by struts, thereby coupling the invoices together.

2. A continuous flow system for use in association with computer printout invoices including side tear holes, the system comprising:

an invoice support assembly comprising a center section and first and second arm sections, the center section having a bottom region and a top region, the top surface having two short side edges and two long side edges, each arm section of the invoice support assembly having inner and outer long side edges and two short side edges, each inner long side edge being hingedly coupled to the top region of the center section; and a plurality of connectors each including an adhesive surface thereon, a release sheet being coupled on top of the adhesive surface, whereby when in an operative orientation a user placing a connector on the center section and removing the release sheet, the user then adapted for positioning a first invoice on the first arm section and a second invoice on the second arm section then raising each arm to an open position supportable by struts, thereby coupling the invoices together.

3. The continuous flow device as set forth in claim 2 wherein each short side edge of the arm sections and center section includes a plurality of conical projection members extending therefrom.

4. The continuous flow device as set forth in claim 3 wherein the center section includes a plurality of bores extending therein.

5. The continuous flow device as set forth in claim 4 and further including:

four struts, one strut being positioned within each bore in the center section, each strut being coupled to an arm section to provide support thereto.

6. The continuous flow device as set forth in claim 5 and further including:

four invoice holders each being hingedly coupled around a short side edge of the arm sections, each invoice holder including an elongated oval aperture, the aperture of each holder being positioned around two conical projection members of the arm sections.

7. The continuous flow device as set forth in claim 6 and further including:

a box clip formed in a elongated generally J-shaped configuration with a linear upper section, a linear lower section and a curved hinge section, the hinge section being pivotally coupled to the bottom surface of the center section.

8. The continuous flow device as set forth in claim 4 wherein the connectors each are formed in a generally rectangular configuration with two long side edges and two short side edges, each long side edge being coupled to a long side edge of another connector, perforations being positioned between the long side edges of each connector, each short side edge including a plurality of holes and a side perforation.

* * * * *